US012473899B2

(12) United States Patent
Crispel et al.

(10) Patent No.: US 12,473,899 B2
(45) Date of Patent: Nov. 18, 2025

(54) PUMPING DEVICE, PLANT AND METHOD FOR SUPPLYING LIQUID HYDROGEN

(71) Applicant: L'Air Liquide, Societe Anonyme pour l'Etude et l'Exploitation des Procedes Georges Claude, Paris (FR)

(72) Inventors: Simon Crispel, Sassenage (FR); Anh Thao Thieu, Les-Loges-en-Josas (FR); Gaetan Coleiro, Sassenage (FR); Fabien Durand, Sassenage (FR); Eric Michalski, Naintre (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 522 days.

(21) Appl. No.: 17/415,685

(22) PCT Filed: Dec. 3, 2019

(86) PCT No.: PCT/FR2019/052899
§ 371 (c)(1),
(2) Date: Jun. 17, 2021

(87) PCT Pub. No.: WO2020/128197
PCT Pub. Date: Jun. 25, 2020

(65) Prior Publication Data

US 2022/0074397 A1 Mar. 10, 2022

(30) Foreign Application Priority Data

Dec. 19, 2018 (FR) ..... 1873280

(51) Int. Cl.
*F04B 15/08* (2006.01)
*F04B 23/06* (2006.01)
(Continued)

(52) U.S. Cl.
CPC ..... *F04B 15/08* (2013.01); *F04B 25/00* (2013.01); *F04B 41/06* (2013.01); *F04B 53/08* (2013.01);
(Continued)

(58) Field of Classification Search
CPC ..... F04B 23/04; F04B 15/08; F04B 25/00; F04B 41/06; F04B 53/08; F04B 53/14;
(Continued)

(56) References Cited

U.S. PATENT DOCUMENTS 2,439,958 A * 4/1948 Anderson ..... F04B 53/162 277/516
4,447,195 A * 5/1984 Schuck ..... F01B 9/02 417/570
(Continued)

FOREIGN PATENT DOCUMENTS

CN 1571883 1/2005
CN 1910370 2/2007
(Continued)

OTHER PUBLICATIONS

International Search Report and Written Report for PCT/FR2019/052899, mailed Apr. 20, 2020.
(Continued)

*Primary Examiner* — David N Brandt
(74) *Attorney, Agent, or Firm* — Elwood L. Haynes

(57) ABSTRACT

Device for pumping liquid hydrogen including, arranged in series between an inlet for fluid to be compressed and an outlet for compressed fluid, a first compression member with a piston forming a first compression stage and a second compression member with a piston forming a second compression stage. The first compression member compresses the liquid hydrogen to a supercritical state. The second compression member compresses the supercritical hydrogen
(Continued)

from the first compression member to an increased pressure, in particular, between 200 and 1000 bar.

10 Claims, 3 Drawing Sheets

(51) Int. Cl.

| | |
|---|---|
| ***F04B 25/00*** | (2006.01) |
| ***F04B 41/06*** | (2006.01) |
| ***F04B 53/06*** | (2006.01) |
| ***F04B 53/08*** | (2006.01) |
| ***F04B 53/14*** | (2006.01) |
| ***F04B 53/16*** | (2006.01) |

(52) U.S. Cl.
CPC ..... *F04B 53/14* (2013.01); *F04B 2015/0822* (2013.01); *F04B 23/06* (2013.01); *F04B 53/06* (2013.01); *F04B 53/162* (2013.01); *F04B 2201/0202* (2013.01)

(58) Field of Classification Search
CPC ..... F04B 53/16; F04B 23/06; F04B 53/06; F04B 53/162; F04B 2015/0822; F04B 2201/0202
See application file for complete search history.

(56) References Cited

U.S. PATENT DOCUMENTS

| | | | | |
|---|---|---|---|---|
| 4,559,786 | A * | 12/1985 | Schuck | F01B 9/02 417/901 |
| 4,692,673 | A * | 9/1987 | DeLong | F04B 17/046 310/34 |
| 5,108,264 | A | 4/1992 | Abdel-Rahman | |
| 2003/0051486 | A1 | 3/2003 | Ursan et al. | |
| 2006/0156742 | A1 | 7/2006 | Farese et al. | |
| 2007/0028628 | A1 * | 2/2007 | Chalk | F04B 15/08 62/50.7 |
| 2008/0008602 | A1 | 1/2008 | Pozivil et al. | |
| 2013/0213059 | A1 * | 8/2013 | Reese | F04B 37/14 62/56 |
| 2017/0137005 | A1 * | 5/2017 | Weh | F04B 23/025 |

FOREIGN PATENT DOCUMENTS

| | | |
|---|---|---|
| EP | 0 087 131 | 8/1983 |
| EP | 2 784 295 | 10/2014 |
| JP | S64 15476 | 1/1989 |
| JP | H04 234578 | 8/1992 |
| JP | 2010 209919 | 9/2010 |
| JP | 2013 170580 | 9/2013 |

OTHER PUBLICATIONS

French Search Report and Written Opinion for FR 1 873 280, mailed Oct. 2, 2019.

* cited by examiner

PUMPING DEVICE, PLANT AND METHOD FOR SUPPLYING LIQUID HYDROGEN

CROSS-REFERENCE TO RELATED APPLICATIONS

This application is a § 371 of International PCT Application PCT/FR2019/052899, filed Dec. 3, 2019, which claims § 119(a) foreign priority to French patent application FR 1 873 280, filed Dec. 19, 2018.

BACKGROUND

Field of the Invention

The invention relates to a pumping device, as well as an installation and a method for supplying liquid hydrogen.

More specifically, the invention relates to a device for pumping liquid hydrogen comprising, arranged in series between an inlet for fluid to be compressed and an outlet for compressed fluid, a first compression component, preferably with a piston, forming a first compression stage, and a second piston compression component forming a second compression stage.

Related Art

A known solution for providing high-pressure gaseous hydrogen from a liquefied hydrogen source involves storing liquefied hydrogen, then transferring, evaporating and heating it, and finally compressing it with conventional systems at ambient temperature.

However, the energy (compression of a low-density compressible fluid) and investment cost of these devices is too high. An alternative solution involves compressing the liquid hydrogen directly, which is then considered to be an incompressible fluid.

Several technologies exist for pumping liquid hydrogen.

For hydrogen energy applications in particular, liquid hydrogen needs to be compressed at high pressures. At these high pressures (>300 bar) pumping becomes more complex due, for example, to the presence of gas at the suction side of the pumps. This presence of gas can be due to the thermal inputs and to the compression heat that vaporizes the liquid and creates cavitation phenomena. The generated gas, which is compressed at high pressure, heats up the pump even more. Another reason can be the rate of leaks through piston sealing segments that increase at high pressure. These relatively "hot" fluid leaks are difficult to recover. The suction side comprising gas thus becomes low density and the pump experiences a drop in the flow and in performance.

The known solutions that recirculate leaks at the pump inlet combine all the aforementioned disadvantages. Document US 2007/0028628 describes a two-stage pump, in which high-pressure leaks are re-injected into the liquid store. This involves a considerable loss of vaporization ("boil-off").

According to the known solutions, the liquid hydrogen is pumped twice (two compression stages in series), see document U.S. Pat. No. 4,447,195. According to some solutions, the pump is immersed in a container filled with liquid hydrogen, which allows optimal thermalization and limits any cavitation problems in the pump. However, this makes pump maintenance more complex.

A pump for liquid hydrogen must be able to satisfy several constraints: a significant life expectancy (in particular due to its difficulty in being maintained in a non-industrial environment despite frequent shutdowns/restarts, very high quality thermal insulation to avoid the vaporization gases ("boil-offs") that generate gaseous hydrogen that is difficult to valorize and that contributes to the cavitation phenomenon in the pump.

The known devices are not completely satisfactory.

SUMMARY OF THE INVENTION

An aim of the present invention is to overcome all or some of the aforementioned disadvantages of the prior art.

To this end, the device according to the invention, which is also according to the generic definition provided in the above preamble, is basically characterized in that the first compression component is suitable for and is configured for compressing the liquid hydrogen in a supercritical state, with the second compression component being suitable for and configured for compressing the supercritical hydrogen supplied by the first compression component at a high pressure, and in particular at a pressure ranging between 200 and 1000 bar.

Furthermore, embodiments of the invention can comprise one or more of the following features:

- the first compression component is suitable for and is configured for compressing the liquid hydrogen at a pressure ranging between 13 and 200 bar, in particular between 14 and 100 bar;
- the first compression component comprises at least one assembly comprising a piston that is translationally movable in a sleeve, with the second compression component comprising at least one assembly comprising a separate piston arranged in a separate sleeve, the pistons of the first and second compression components being moved in their respective sleeve in alternating movements at respective independent determined movement speeds, the movement speed of the at least one piston of the first compression component being less than the movement speed of the at least one piston of the second compression component;
- the movement speed of the at least one piston of the first compression stage 2 ranges between 0.02 m/s and 0.5 m/s, and in particular between 0.02 m/s and 0.2 m/s;
- the movement speed of the at least one piston of the second compression stage ranges between 0.02 m/s and 1 m/s, for example;
- the at least one piston of the first compression component and/or the at least one piston of the second compression component is moved via a linear actuator drive mechanism ensuring axial guidance of the piston in its sleeve, in particular a mechanism of the screw and planetary roller type and activated by an electric motor;
- the first compression component and/or the second compression component is thermally isolated in a vacuum;
- the first compression component and/or the second compression component comprise a heat shield that is thermalized by a cooling fluid;
- the device comprises a thermalization circuit comprising a first upstream end intended to be connected to a liquefied gas source, and in particular a source of liquid hydrogen intended to be compressed by the pumping device, and at least one downstream end ensuring a thermal exchange between the liquefied gas and the heat shield;
- the thermalization circuit comprises a portion connecting the heat shield to the compression chamber of the compression component and configured to transfer at least some of the liquefied gas that has thermally exchanged with the heat shield in the compression chamber of the compression component, i.e. the compression component compresses liquefied gas that has been used to cool its heat shield;

the device comprises a circuit for returning thermalization fluid comprising an end connected to the heat shield and an end intended to be connected to a liquefied gas source and/or to a recovery zone for discharging at least some of the heated liquefied gas used to cool the heat shield;

the movement speed of the piston of the first compression component ranges between 0.02 and 0.05 m per second;

the movement speed of the piston of the second compression component ranges between 0.02 m/s and 1 m/s;

the first compression component and/or the second compression component comprise a circuit for collecting hydrogen vaporized therein, said circuit comprising an outlet for discharging to a recovery zone;

the circuit for recovering fluid leaks passing through the one or more piston(s) directs at least some of said leaks from the first compression stage to the source;

the circuit for recovering fluid leaks passing through the one or more piston(s) directs at least some of said leaks from the second compression stage to the thermalization circuit, and in particular to the heat shield, with a view to it being cooled, then, if applicable, it being reintroduced into the second compression stage with a view to it being re-compressed;

the first compression component is arranged in a shell forming a heat shield that is thermalized by a cooling fluid, with the circuit for fluid to be compressed that transfers the fluid from the source to the first compression stage passing through the shell of the first compression stage, said shell of the first compression stage forming a supply chamber of the at least one piston of the first compression stage and a heat shield of the first compression stage.

The invention also relates to an installation for supplying pressurized liquid hydrogen comprising a pumping device according to any one of the aforementioned or following features, the installation comprising a liquefied hydrogen source, and a transfer circuit comprising a duct connecting the source to the inlet of the pumping device suitable for and configured for supplying liquid hydrogen to the pumping device with a view to its compression and its delivery to the outlet.

According to other possible particular features:

the installation comprises at least one return duct having an upstream end connected to the pumping device and a downstream end connected to the source and suitable for and configured for discharging gas vaporized inside the pumping device to the source;

the at least one return duct comprises at least one from among: a manual or controlled valve, a relief valve.

The invention also relates to a method for supplying pressurized liquid hydrogen using a device according to any one of the aforementioned or following features or an installation according to any one of the aforementioned or following features, the method comprising a step of supplying liquid hydrogen to the inlet of the pumping device, a step of compressing this liquid hydrogen in the first compression component at a pressure ranging between 14 and 100 bar and at a temperature ranging between 20 and 40 K, then a step of additional compression, in the second compression component, of the hydrogen exiting the first compression component at a pressure ranging between 50 and 1000 bar and at a temperature ranging between 40 and 150 K.

According to other possible particular features:

The invention can also relate to any alternative device or method comprising any combination of the aforementioned or following features within the scope of the claims.

BRIEF DESCRIPTION OF THE FIGURES

Further features and advantages will become apparent upon reading the following description, which is provided with reference to the figures, in which.

DETAILED DESCRIPTION OF THE INVENTION

Figure 1:
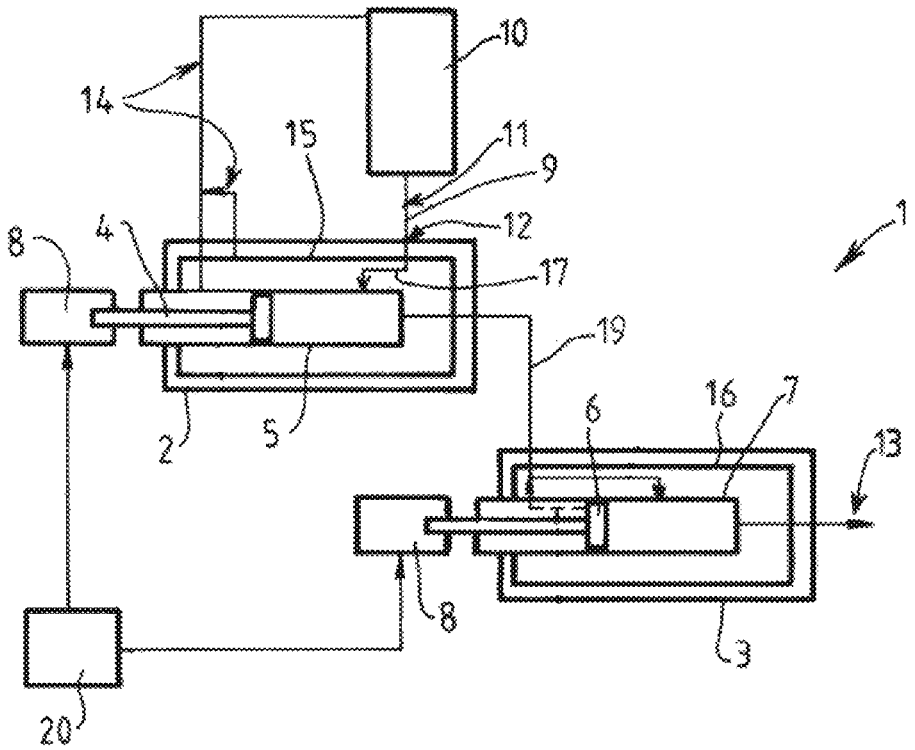
FIG. 1 shows a schematic and partial view illustrating an example of the structure and of the operation of a pumping device according to one possible embodiment of the invention.

The device 1 for pumping liquid hydrogen shown in [FIG. 1] comprises, arranged in series between an inlet 12 for fluid to be compressed and an outlet 13 for compressed fluid, a first compression component 2 and a second compression component 3.

The first compression component 2 preferably is of the piston(s) type and forms a first compression stage for the fluid admitted via the inlet 12.

As an alternative to piston compression, it is possible to contemplate technology of the gear or roots, or centrifugal type, or any other suitable technology.

The second compression component 3 is also preferably of the piston(s) type and forms a second compression stage for the fluid toward the outlet 13.

Figure 2:
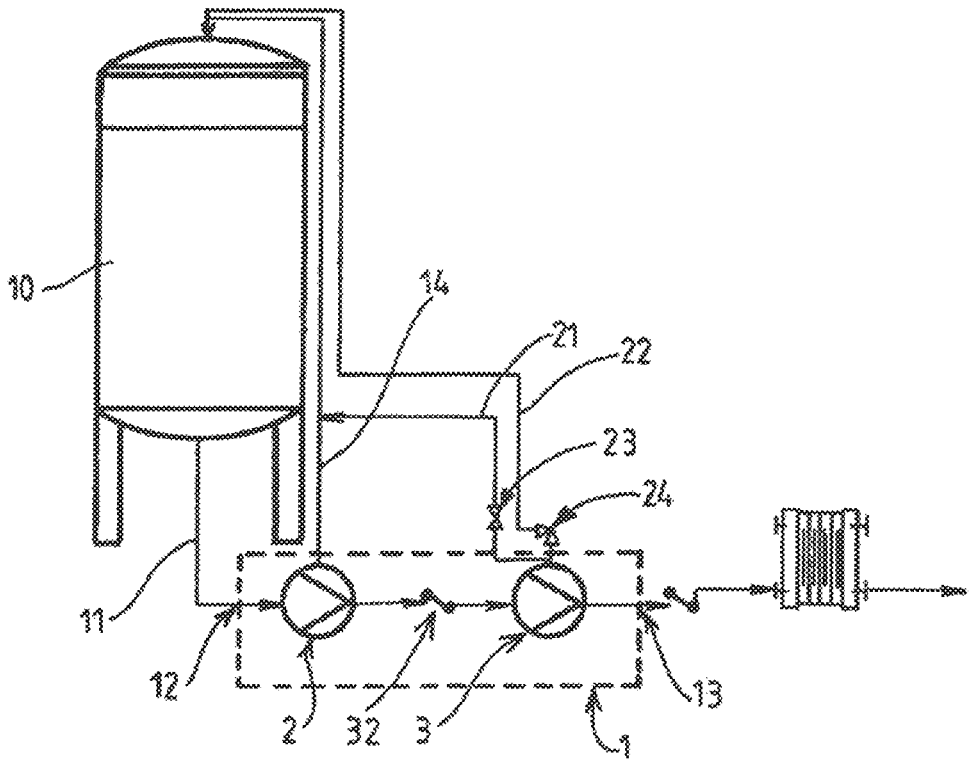
FIG. 2 shows a schematic and partial view illustrating an example of the structure and of the operation of an installation according to one possible embodiment of the invention.
Figure 3:
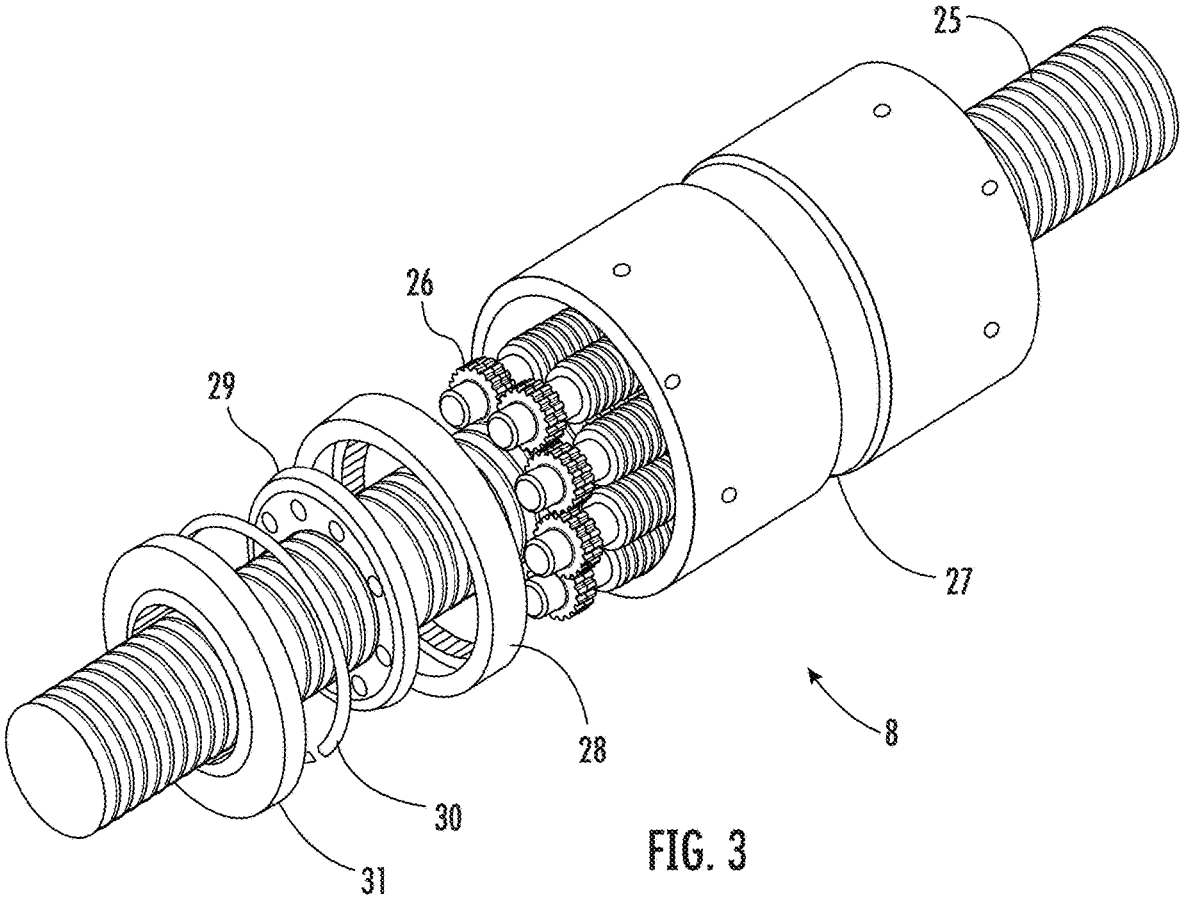

The two compression components 2, 3 particularly may or may not be housed in the same casing or housing (see [FIG. 2]).

According to an advantageous feature, the first compression component 2 is suitable for and is configured for compressing liquid hydrogen in or to a supercritical state.

Preferably, the first compression component 2 receives liquid hydrogen in a saturated state, for example, at a pressure ranging between 0 and 10 barg and a temperature ranging between 20 and 32 K.

In other words, the first compression component 2 is configured for compressing liquid hydrogen to a supercritical state (beyond the following conditions: Pc=12.98 bar, $T_c$=33 K). In this state, the fluid can no longer coexist in two phases (liquid and gas).

For its part, the second compression component 3 is suitable for and is configured for compressing the supercritical hydrogen supplied by the first compression component at an increased pressure, and in particular at a pressure ranging between 200 and 1000 bar.

Thus, at the inlet of the first compression stage 2, the fluid can have a pressure ranging between 0 and 10 barg and a temperature ranging between 20 and 32 K, for example.

At the outlet of the first compression stage 2, the fluid can have a pressure ranging between 13 and 150 barg (in particular between 14 and 100 barg) and a temperature ranging between 20 and 50 K, for example.

At the outlet of the second compression stage 3, the fluid can have a pressure ranging between 50 and 1000 barg and a temperature ranging between 40 and 150 K, for example.

In other words, the second compression component 3 completes the main work of compressing the fluid.

Thus, the first compression component 2 can be suitable for and configured for compressing the liquid hydrogen at a pressure ranging between 5 and 200 bar, and preferably between 13 and 150 barg, in particular between 14 and 100 barg.

This architecture prevents compressing a fluid in the second compression component 3 with properties, in particular the density, that are highly sensitive and poorly managed. This allows the cavitation phenomena (boil-off) to be limited or managed in an item of equipment dedicated to and intended for this purpose (first compression component 2). Indeed, by pumping liquid, a difference, even if it is very slight, in the saturation generates gas in the liquid and significantly modifies the density of the pumped fluid. The supercritical fluid does not change phase and its density varies progressively.

Indeed, by deviating from the saturation even slightly, the density of the fluid is thus significantly modified, and even more so when the operating pressure is low. Thus, the high-pressure compression is concentrated on the second compression stage.

The supercritical fluid produced by the first compression stages is thus transferred to the second compression stage (which preferably is independent of the first compression stage). This second compression stage thus can be designed to produce the main compression work up to the final required pressure level.

Preferably, the supply of fluid originating from the first compression stage to the second compression stage occurs through the outer shell 16 that houses the one or more piston(s) of the second compression stage. Thus, the shell 16 around the one or more piston(s) of the second compression stage 3 acts both as a supply chamber for the compression chamber of said pistons 6 and as a heat shield.

The intermediate operating conditions, the active regulation of pressure between the two compression stages (via, for example, the compression speed of the first stage) and the thermo-hydraulic design can be determined so as to generate little or no losses (boil-off) (and low-pressure return) at the intake of the second pressure stage.

The proposed architecture allows the movement speed of the first compression component (piston(s) 4) to be adjusted to control the thermodynamic conditions of the fluid at the inlet of the second compression component (i.e. at the inlet of the one or more relevant piston(s) 6).

As illustrated in [FIG. 2], a one-way valve 32 can be provided between the two compression stages.

The relatively different speeds of the two compression stages and the drive/control mode of the pistons facilitate the adjustment of the pressure.

The first compression component 2 is preferably configured for compressing relatively slowly (for example, at a piston movement speed of 2 to 5 cm/s, and at a frequency of the order of 5 strokes/minute). This will allow the fluid to be brought to a supercritical state whilst limiting, for example, the irreversible consequences, thermal inputs, cavitation effects, and the wear of the components. The physical properties of the fluid (viscosity, density) are then better controlled and facilitate the completion and the operation of the second compression stage (dimensions, materials), whilst providing the seal and the thermalization.

As illustrated in [FIG. 1], the first compression component 2 can comprise a piston 4 that can translationally move in a sleeve 5. The piston 4 and the sleeve 5 conventionally define a compression chamber.

Similarly, the second compression component 3 can comprise a separate piston 6 arranged in a separate sleeve 7. The pistons 4, 6 of the first and second compression components are moved in their respective sleeve 5, 7 in alternating movements at respective determined movement speeds. Advantageously, the movement speed of the piston 5 of the first compression component 2 is preferably less than the movement speed of the piston 7 of the second compression component 3.

As schematically shown in [FIG. 1], the piston 4 of the first compression component 2 and/or the piston 6 of the second compression component 3 can be moved via a respective drive mechanism 8 of the screw and planetary roller type. These mechanisms are preferably activated by respective separate motors 20, in particular electric motors.

Of course, a common motor could be contemplated.

Preferably, the movement speeds of the pistons 4, 6 of the two compression stages are separate and mechanically independent. In other words, there is no mechanical coupling between the pistons 4, 6 of the two compression stages that would mechanically determine the speed of the pistons of one compression stage as a function of the movement speed of the pistons of the other compression stage.

The speed of the one or more piston(s) 4 of the first compression stage 2 can be computed in real time in order to optimize the stability of the thermodynamic conditions at the second compression stage 2. Thus, the movement speeds of the pistons of the two compression stages can be thermodynamically interdependent, but independently mechanically controlled.

Therefore, the first compression stage can comprise or can be made up of at least one piston 4-sleeve 5 assembly that is thermalized (i.e. kept cold at a temperature, for example, ranging between 20 and 30 K). The at least one piston 4 and sleeve 5 assembly is preferably housed in a sealed shell 15. This thermalization can occur at the shell 15 containing the cryogenic intake fluid. This shell 15 can be isolated in a vacuum with an outer wall. The shell 15 houses and thermally insulates the at least one piston 4-sleeve 5 assembly. Of course, each piston 4-sleeve 5 assembly could be housed in a separate respective shell.

This shell 15 can form a heat shield that is cooled by a cooling fluid inside or outside the device, for example, liquid hydrogen supplied by the source 10 of fluid that is intended to be compressed.

Thus, the shell 15 can be a volume filled with cooling fluid and/or a mass cooled by the fluid.

The device can comprises a thermalization circuit 9 comprising a first upstream end (duct 11) connected to a liquefied gas source 10, and in particular a source of liquid hydrogen that is intended to be compressed by the pumping device, and at least one end ensuring a thermal exchange between the liquefied gas and the shell 15.

The source 10 stores, for example, liquid hydrogen at a pressure ranging between 1 and 10 barg.

The thermalization circuit 9 can comprise a portion 17 connecting the shell 15 to the compression chamber of the compression component 2. This portion 17 is configured to transfer at least some of the liquefied gas that has thermally exchanged with the shell 15 in the compression chamber of the compression component 2. In other words, the compression component 2 preferably compresses at least some of the liquefied gas that has been used to cool its shell 15 forming a heat shield.

Thus, the liquid hydrogen can pass through the shell 15 forming a heat shield before being admitted into the compression chamber. The piston 4/sleeve 5 assembly is therefore immersed and cooled in the shell 15 forming a heat shield. The evaporated liquid, therefore very little liquid, can be recirculated in the source 10 via a line 14.

The fluid compressed by the first compression component is transferred 19 into the compression chamber of the second compression component 3. Before entering the compression chamber of the second compression component 3, as before, the fluid compressed by the first compression component can be used to cool the shell 16 forming a heat shield 16 for the second compression stage.

Preferably, the supercritical fluid compressed by the first compression component 2 is transferred through and into the shell 16 (which is preferably a volume and not only a cooled mass). This fluid passes through the volume of the shield 16 forming a heat shield and cools the piston 6-sleeve 7 assembly before entering the compression chamber of the second compression component. Any leaks from the piston(s) can be recirculated in the volume of the shell 16 in order to be subsequently re-compressed.

With the fluid in the shell 16 forming a heat shield being supercritical, it is possible to configure the thermal inlets, the compression heat and the leaks without cavitation, therefore without significant degradation of the flow of the pump.

The second compression component 3 can particularly have an insulation structure that is similar to that of the first compression component 2. In other words, the second compression stage therefore can comprise or can be made up of at least one piston 6-sleeve 7 assembly that is thermalized (i.e. kept cold at a temperature ranging between 30 and 50 K). This thermalization can involve a shell 16 containing the cryogenic intake fluid, this shell 16 can be isolated in a vacuum with an outer wall. This shell 16 can form a heat shield, which is further cooled by a cooling fluid, for example, liquid hydrogen supplied by the fluid source 10 (fluid originating directly from the source 10 or fluid having already been used in the first compression stage and/or by an external cooling fluid source or another type of cold supply).

The device 1 preferably comprises a circuit 14, 21, 22 for returning thermalization fluid comprising an end connected to the shell 15 and an end intended for a recovery zone, and in particular the liquefied gas source 10. This allows at least some of the heated liquefied gas used to cool the shell 15 forming a heat shield to be discharged and, if applicable, recovered.

Preferably, the circulation of the fluid for the thermalization is obtained by a thermosiphon effect. In other words, the thermalization evaporates liquefied fluid, which reduces its density and causes the cold gas to return to the source 10, with the return line being configured to allow and to optimize this operation.

In this way, the sealing faults, which are reduced as much as possible by this dedicated operation of the first compression stage 2 (lower power, lower pressure, lower speed, and perfectly thermalized), nevertheless can be picked up and returned to the source tank 10.

As illustrated in [FIG. 2], it is also possible for one or more duct(s) to be provided for recovering gas vaporized in the second compression component 3.

For example, one or two ducts 21, 22 can be provided for returning heated fluid to the source 10 directly 22 or via a similar duct 14 for the first compression component 2. The one or more duct(s) 21, 22 can comprise at least one valve 23 and/or one flap 24 forming a valve opening at a determined pressure level.

In the operating phase (i.e. in the compression phase), the second compression component 3 is cooled by the incoming fluid. The sealing faults and the thermal inputs are therefore absorbed by the fluid before being admitted into the pumping component. In the standby phase (no compression), the second pumping component 3 could be kept cold by the circuit 21-22 via a circulation of fluid. This operation allows the gas losses of the high-pressure compression to be reduced as much as possible. Preferably, the two compression components 2, 3 are configured to operate and to be able to be controlled independently. In other words, the movement speed of each piston 4, 6 can be controlled independently of the movement speed of the other piston (the two compression stages are mechanically independent). Thus, for example, the movement speeds of the two pistons 4, 6 are not directly interlocked or mechanically dependent on each other. It is thus possible to modify the movement speed of the one or more piston(s) of a compression stage, without this automatically modifying the movement speed of the one or more piston(s) of the other compression stage. The movement speeds of one or of the two pistons can be fixed or modified to respective values, which are not directly correlated (on the sole condition that the movement speed of the piston of the first compression component 5 is preferably less than the movement speed of the piston of the second compression component). Similarly, the movements of the two pistons of the two compression stages can be non-synchronized.

Therefore, the two compression components 2, 3 can be adjusted in terms of speed and/or of position and/or of movement stroke in order to respectively control the intermediate thermodynamic conditions, in particular the pressure (at the outlet of the first compression stage 2) and the outlet pressure of the second compression stage. This intermediate pressure can be controlled at a value between 13 and 150 bar, for example.

The difference in the movement speed of the pistons 4, 6 between the two compression stages can be selected so as to be big enough to stabilize the pressure between the two compression stages. If applicable, a buffer store can be provided between the two compression stages to increase this pressure stability.

The losses of the second compression stage 3 are limited by the recirculation of fluid at the intake, whereas the differences in the speeds of the pistons allow the lifetime and the time between two maintenance operations to be optimized, whilst achieving the required performance level. This helps to limit or remove the losses at the second compression stage 3. As a result, a vapor recovery circuit optionally can be omitted for the second compression stage.

The first stage preferably is particularly thermally optimized (vacuum chamber and pump thermalized by the intake fluid) for limiting the thermal inputs. The evaporation of the hydrogen, the residual amount of evaporated gas, is preferably returned to the source store 10.

In this way, the second compression stage can be thermally balanced and generate little or no gas losses. This second compression stage 3 particularly can be thermally balanced by design. In other words, the compression and friction energy can be discharged in order to generate a stable temperature for the components inside the second compression component 3.

In the event of non-use (between two uses of the pumping device), the first compression component 2 can be activated intermittently to keep the device cold, and in particular the second compression component 3. As an alternative embodiment or in combination, cooling can be provided (heat exchanger(s) with a loop for cooling the fluid from/to the source 10 as a thermosiphon via the ducts 21-21, for example).

The pumping device 1 (and/or the installation) can comprise an electronic component for storing and processing data comprising, for example, a microprocessor for controlling all or some of the components (valve(s) and/or motor and/or motor, etc.).

Thus, according to the invention the pumping device can comprise a two-stage pump (two compression stages), one of the stages (first stage 2) of which compresses the subcritical fluid, whereas the second stage 3 compresses the supercritical fluid. A third high-pressure compression stage optionally can be provided downstream. Advantageously, the device can control the one or more movement speed(s) of the compression pistons 4, 6, allowing the lifetime of the pistons (and of the seals) to be extended.

In the example described above, the first compression component 2 and the second compression component 3 each comprise a single piston that can move in its sleeve (compression chamber). Of course, the first 2 and/or the second 3 compression stage can comprise more than one piston/sleeve assembly, and in particular two pistons that can each move in a respective sleeve (compression chamber). Thus, the first compression stage 2 could comprise a single piston/sleeve assembly (which stage is called "single-head stage"), whereas the second stage 3 could comprise two pistons that can respectively move in two compression chambers (which compression stage is called "twin-head compression stage").

In the case of multiple piston/sleeve assemblies with one compression stage, these piston/sleeve assemblies are arranged in parallel.

The invention has been described in an example with two compression components 2, 3 in order to achieve the target pressure (1000 bar, for example). Of course, it is possible to contemplate providing an architecture in which at least one third intermediate compression stages is used between the first stage 2 (which compresses, for example, up to a pressure of 200 bar) and the last compression stage 3 (which compresses up to the target pressure, in particular 1000 bar).

In some operating configurations, the movement speed of the at least one piston 5 of the first compression stage can be greater than the movement speed of the at least one piston 6 of the second compression stage.

This can be used, for example, when the pump is in a standby mode (second piston stopped and the first piston moving very slowly).

In another configuration, if the first compression stage has one or more undersized piston(s) in relation to the one or more piston(s) of the second compression stage, in this case the piston(s) of the first compression stage can move at a speed that is greater than that of the movement of the one or more piston(s) of the second compression stage.

For the sake of simplification, in the examples shown, each compression stage comprises a single piston 4, 6. Of course, each compression stage can comprise one or more piston-sleeve assemblies. For example, the first and the second compression stage can each comprise two piston-sleeve assemblies in parallel (i.e. two pistons per compression stage). Each compression stage is preferably powered by a separate specific motor. In other words, there are two motors, with each of the motors moving the pistons of a respective compression stage.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A device for pumping liquid hydrogen comprising, arranged in series:

an inlet for the liquid hydrogen to be compressed;

a first compression component, forming a first compression stage, comprising at least one assembly that comprises a piston that is translationally movable in a sleeve;

a second compression component, forming a second compression stage, comprising at least one assembly that comprises a piston that is translationally movable in a sleeve; and an outlet for supercritical hydrogen, further comprising a thermalization circuit comprising a first upstream end connected to a liquid hydrogen source, and at least one downstream end ensuring a thermal exchange between the liquid hydrogen and a shell, wherein: the first compression component is configured for compressing the liquid hydrogen into a supercritical state, wherein the second compression component is configured for compressing the supercritical hydrogen supplied by the first compression component to a pressure ranging between 200 and 1000 bar, wherein the piston of the at least one assembly of the first compression component is translationally movable in the respective sleeve at a determined movement speed, wherein the piston of the at least one assembly of the second compression component is translationally movable in the respective sleeve at a determined movement speed, wherein the determined movement speed of the piston of the at least one assembly of the first compression component is independent of the determined movement speed of the piston of the at least one assembly of the second compression component, wherein the first compression component and/or the second compression component is arranged in the shell forming a heat shield that is thermalized by a cooling fluid, and wherein the thermalization circuit comprises a portion connecting the shell to a compression chamber of the first or second compression components and configured to transfer at least some of the liquid hydrogen that has thermally exchanged with the shell to the compression chamber of the first compression component.

2. The device of claim 1, further comprising a first motor moving the piston of the at least one assembly of the first compression stage and a second motor moving the piston of the at least one assembly of the second compression stage.

3. The device of claim 1, wherein the first compression component is suitable for and configured for compressing the liquid hydrogen to a pressure ranging between 13 and 200 bar.

4. The device of claim 1, wherein the first compression component is suitable for and configured for compressing the liquid hydrogen to a pressure ranging between 14 and 100 bar.

5. The device of claim 1, wherein the determined movement speed of the piston of the at least one assembly of the first compression stage ranges between 0.02 m/s and 0.5 m/s and the determined movement speed of the piston of the at least one assembly of the second compression stage is below 2 m/s.

6. The device of claim 1, wherein the determined movement speed of the piston of the at least one assembly of the first compression stage ranges between 0.02 m/s and 0.5 m/s and the determined movement speed of the piston of the at least one assembly of the second compression stage is below 1 m/s.

7. The device of claim 1, wherein the piston of the at least one assembly of the first compression component and/or the piston of the at least one assembly of the second compression component is moved via a linear actuator drive mechanism ensuring axial guidance of the respective first compression component or second compression component piston in the respective first compression component or second compression component sleeve.

8. The device of claim 1, wherein the first compression component and/or the second compression component is thermally isolated in a vacuum.

9. An installation for supplying pressurized liquid hydrogen comprising the device of claim 1, the installation comprising the liquid hydrogen source and a transfer circuit that comprises a duct connecting the source to the inlet of the device suitable for and configured for supplying the liquid hydrogen to the device for compression thereof and delivery thereof to the outlet.

10. The installation of claim 9, further comprising at least one return duct having an upstream end connected to the device and a downstream end connected to the source and suitable for and configured for discharging gas vaporized inside the device to the source.

* * * * *